US005603151A

United States Patent [19]

Wille

[11] Patent Number: 5,603,151

[45] Date of Patent: Feb. 18, 1997

[54] BLIND FASTENER SETTING DEVICE

[75] Inventor: Lothar Wille, Mörfelden-Walldorf, Germany

[73] Assignee: GESIPA Blindniettechnik GmbH, Frankfurt am Main, Germany

[21] Appl. No.: 494,281

[22] Filed: Jun. 23, 1995

[30] Foreign Application Priority Data

Jun. 30, 1994 [DE] Germany ..... 44 22 877.5

[51] Int. Cl.[6] ..... B21J 15/32

[52] U.S. Cl. ..... 29/243.528; 72/477

[58] Field of Search ..... 72/391.2, 477, 72/478; 29/243.527, 243.528

[56] References Cited

U.S. PATENT DOCUMENTS

| | | | |
|---|---|---|---|
| 1,142,797 | 6/1915 | Burrell | 72/477 |
| 4,552,010 | 11/1985 | Hein | 29/243.528 |
| 4,648,259 | 3/1987 | Pendleton | 72/391 |
| 4,825,682 | 5/1989 | Orav et al. | 72/477 |
| 5,361,474 | 11/1994 | Yang | 29/243.528 |

FOREIGN PATENT DOCUMENTS

| | | |
|---|---|---|
| 0173817A1 | 4/1985 | European Pat. Off. . |
| 3124648 | 6/1981 | Germany . |

*Primary Examiner*—David Jones
*Attorney, Agent, or Firm*—Darby & Darby

[57] ABSTRACT

A blind fastener setting device includes a drawing mechanism and an adjustably supported tip piece. The tip piece has several mandrel guide channels, each of which can be aligned with respect to the drawing mechanism. The tip piece can be easily adjusted without the overall size of the device having to be enlarged to any significant extent. The tip piece has a cross-sectional shape of a polygon which has an uneven number of sides. The mandrel guide channels each extend from a side to the oppositely disposed corner.

16 Claims, 1 Drawing Sheet

BLIND FASTENER SETTING DEVICE

BACKGROUND OF THE INVENTION

1. Field of the Invention

The present invention relates to a blind fastener setting device having a drawing mechanism and an adjustably supported tip piece that has several mandrel guide channels, each of which can be aligned with respect to the drawing mechanism.

2. Discussion of the Related Art

Blind rivets and blind rivet nuts are set by a blind fastener setting device. The most commonly used rivet dimensions today lie between 2 and 5 mm in diameter, and are made of various materials. The diameter of the rivet mandrels, which are designed to break off at a predetermined breaking point when the required setting force has been reached, have diameters between 1.5 and 3.2 mm. Because of these varying diameters, the tip pieces on which the rivet heads are supported during setting are matched to the rivet mandrel diameter. Thus, the bores of the tip pieces that are used for the most commonly used rivets lie in the range from 1.9 to 3.6 mm. If the bore or the mandrel guide channel is too small, that mandrel guide cannot work with larger rivets because the thicker mandrels will not fit into the tip piece. If, on the other hand, the mandrel guide has a bore that is too large, thinner mandrels will fit into the tip piece, but working with the thinner blind rivet is still problematical. For example, the mandrel can be pulled all the way through the rivet without any breaking off occurring. Additionally, visible ring-shaped impressions and deformations can occur because the necessary supporting surface is not present. Therefore, the tip piece must always be chosen so that it matches the rivet size that is being used.

As a result, most setting devices are provided with exchangeable tip pieces. However, a tool is usually required to change the tip piece. The number of working steps involved in changing a rivet size is substantial. To exchange a tip piece, the tip piece must be removed by using the tool, a matching tip piece must be sought out, and then installed by once again using the tool. The tip piece that was removed must then be properly placed so that it will not be lost. As a result, for applications in which a frequent changing of rivet sizes is necessary, the required equipment preparation time takes on considerable dimensions.

U.S. Pat. No. 4,648,259 to Pendleton discloses an adjustable tip piece for blind rivet setting devices. The tip piece includes two jaws. Each jaw has a triangular recess so that the jaws, which lie opposite each other, together form a mandrel guide channel that is approximately rectangular or square in cross-section. The two jaws taper down to a point. With the aid of a union nut, the jaws can, by tilting, be brought towards each other in the region of the tip piece. If a larger diameter mandrel guide channel is used, a slot is created between the two jaws. If a smaller diameter mandrel guide channel is used, the two supporting surfaces, which are arranged in a coplanar fashion when the diameter is larger, are disposed at an angle to the head of the rivet, which leads to visible impressions on the head of the rivet, and to a reduction of the setting ability.

EP 0 173 817 A1 discloses a blind fastener setting device, where the tip piece can be rotated around an axis that encloses an angle of approximately 45° to the drawing direction of the drawing mechanism. Thus, the mandrel guide channels are inclined at this angle with respect to the axis. By rotating the tip piece around the axis, the individual mandrel guide channels can be brought into alignment with the drawing mechanism. A disadvantage with this design is that the tip piece and the housing have a relatively high manufacturing expense. In addition, the housing must be of a relatively large overall size, and the diameter of the housing in particular must be made correspondingly large. The larger size of the housing makes the device heavy and unwieldy. In many cases, rivets are required which have rivet mandrels with excessive lengths so that the drawing mechanism can grip the mandrel, which is fed through the tip piece and the necessary parts of the housing.

SUMMARY OF THE INVENTION

It is an object of the present invention to provide a blind rivet setting device that permits for a rapid exchange of rivet mandrel sizes.

A blind rivet fastener setting device according to the present invention includes a tip piece that has, when viewed in cross-section, the shape of a polygon having an uneven number of sides. The mandrel guide channels run from a side of the polygon to the opposite corner. The term "corner" is not necessarily limited to the situation where two adjacent sides of the polygon come together at a specific angle but also refers to the transition between two adjacent sides. A transition that is roughly in the shape of a curve or a progression is also included in the definition of a corner.

The use of a polygon with an uneven number of sides, makes it possible to direct a number of mandrel guide channels through the tip piece, without the diameters having a mutual effect on one another. A flat surface is provided at one end of each of the mandrel guide channels against which the rivet can rest for setting. Thus, the rivet can be set without receiving any kind of profiling or impressions. The overall height of the tip piece is either equal to or exceeds that of conventional tip pieces by only a very small extent. As a result, it is possible to work on normal rivets without using rivet mandrels that have an excessive length. The increase in weight from using a polygonal tip piece can hardly be noticed in practice. The housing of the device can practically be left unchanged from the point of view of its external dimensions.

The polygon is configured as a regular polygon to simplify the manufacturing of the tip piece and to simplify the mounting of the tip piece in the device. The tip piece can always be handled and worked with in the same way, without regard to the size of the mandrel guide channel.

The tip piece can preferably be rotated around an essentially fixed axis, which runs perpendicular to the drawing direction of the drawing mechanism. When the tip piece is adjusted, the tip piece essentially remains fixed in place in the device. The danger of loss is thus reduced drastically, because a certain alignment of the tip piece is given by the fixed mounting. This ability to rotate the tip piece considerably increases the operational convenience of the blind rivet setting device.

The tip piece preferably has bearing journals which project perpendicularly with respect to the mandrel guide channels. The tip piece is supported on a bearing surface portion of the housing by the bearing journals. The drawing mechanism is movable with respect to the beating portion of the housing. The housing thus absorbs, via the tip piece, the forces that the drawing mechanism exerts on the rivet mandrel. The beating journals are used to transfer force from the tip piece to the housing, and to adjust the position of the tip piece as well.

In a preferred embodiment, the bearing journals are round. In another embodiment, at least one of the bearing journals has a polygonal shape in cross-section, with the sides being reduced in size as compared to the sides of the tip piece. The polygonal shaped beating journal is rotated with respect to the polygon of the tip piece by an angle that amounts to 180° divided by the number of sides that the polygon has so that the bearing journal lies against a surface that extends in a direction that is essentially perpendicular to the drawing direction. Thus, with the aid of the polygonal journal, fixing of the tip piece in the preferred position can be more readily achieved. Because of the angular position of the journal with respect to the tip piece, the side of the journal polygon that lies against the bearing surface is essentially parallel to the side of the tip piece that, in this position, forms the surface that the rivet lies against. Since the bearing surface extends in an essentially perpendicular direction to the drawing direction (i.e., a normal vector from the bearing surface is parallel to the drawing direction), the force that is acting upon the head of the rivet is completely supported by the beating surface. The side of the journal polygon that lies against the bearing surface creates an increased resistance to the rotation of the tip piece. Thus, to rotate the tip piece, the tip piece must first be displaced in the drawing direction, at least by a small distance.

The tip piece in its ready state (i.e., that state in which the device can accept a blind rivet, or a blind rivet nut in order subsequently to set the rivet) preferably has one corner of the polygon projecting into a recess in a housing part. The projecting corner and at least part of the sides that define that corner lie against the housing part. In the ready state, the drawing mechanism is in its most forward position. The tip piece must be fixed in place in such a way that no unintentional displacement occurs. In other words, the desired diameter of mandrel guide channel is actually available for use. As soon as the drawing mechanism has gripped the mandrel, this fixing in position of the tip piece is no longer necessary because the rivet mandrel holds the tip piece in the appropriate alignment. The projecting corner of the polygon is used for fixing the tip piece in its ready state. As a result of the fact that this corner projects into a recess in the housing part and at the same time, the two sides that define the projecting corner lie, at least partially, against the housing part, an unintentional rotating of the tip piece is practically impossible. The polygon, with an uneven number of sides, provides the advantage that a number of mandrel guide channels can be provided. Additionally, the polygonal tip piece advantageously greatly simplifies the fixing of the tip piece in place within the housing with no additionally required measures.

The housing part, which receives the projecting corner of the tip piece, is preferably movable with respect to the main housing to make it easier to adjust the tip piece. It is only necessary to move the housing part far enough so that the corner which projects into the housing part can be moved out of the housing part. If the housing part is then moved back into its original position, the tip piece is once again fixed in place. In this regard, a device is provided to bring about an increased friction engagement between the housing part and the housing. Thus, due to the increased friction, the housing part will normally remain in its adjusted state. To move the housing part will require a predetermined outside force which, for example, has to be applied by an operator. Therefore, an unintentional displacement of the housing part with respect to the housing, for example, in the course of a work procedure, can largely be prevented.

The housing part, in its ready state, is preferably impinged upon by a restoring force. The restoring force secures the tip piece against rotation because it presses the housing part against the tip piece. The restoring force advantageously acts upon the housing part via the drawing mechanism. Because a restoring force is required for the drawing mechanism in any case, and is normally applied by means of a spring, and in particular, a pressure spring, the present invention can also use the force of the pressure spring to apply the restoring force for the housing part against the tip piece. Thus, in the ready state, the desired fixing in place of the tip piece is achieved. To adjust the tip piece, the drawing mechanism must be drawn back a small distance. This can be carried out either manually or by means of a motor. After moving the drawing mechanism, the housing part is then released to the extent that it can be moved with respect to the housing.

The housing part is also preferably configured as a jaw opening device for the drawing mechanism. If the drawing mechanism is again moved into its most forward end position, that is, into its ready state, the jaws must be opened to be able to remove the old rivet mandrel and accept a new rivet mandrel. If the housing part is configured so that it can be used as a jaw opening device, the housing part ensures that in the ready state, the jaws will be open, because the housing part is always pressed with the necessary force against the tip piece. As soon as the rivet mandrel can be removed, the operator will immediately know that the fixing in place of the tip piece has again been achieved.

The tip piece is preferably formed from a spherical disk which is essentially symmetrical on both sides of the mandrel guide channels. The tip piece has a level flattened area in its perimeter in the region of each of the mouths of a mandrel guide channel. The mandrel guide channels lie in a plane that forms the center plane of the spherical disk. If a sphere or the spherical disk is flattened, the flattened area has a circular shape, which is exactly the shape that is desired as the surface for the rivet head to lie against. A spherical disk can be manufactured relatively easily, as a rotating part for example. The flattened areas can be made just as easily, for example by milling. Because of the use of a spherical disk, the shape of the polygon can only be seen in the center plane (i.e., a cross-sectional view taken from the center plane). From the two faces of the spherical disk, only a circle can still be seen from the outside. Thus, the recess in the housing part in the region of the faces of the spherical disk can be provided with an appropriate inner radii.

The width of the spherical disk preferably corresponds to the length of one side of the polygon. The tip piece is kept as small as possible so that the flattened areas have a diameter that exactly corresponds to the width of the tip piece or the spherical disk. The individual adjacent flattened areas then meet at the corners of the polygon. Strictly speaking, however, this meeting of the individual flattened areas only occurs at the center plane. The further you go out from the center plane, the greater are the transitions that occur, in the form of curves, from one flattened area to the next.

A union nut is provided which holds the tip piece in the housing. A union nut can be screwed on to the housing easily. The union nut gives the tip piece the necessary freedom of movement within the interior of the housing so that the position of the tip piece can be appropriately adjusted. The union nut preferably acts only upon the beating journals so that the tip piece can indeed be rotated freely if other means of fixing are released. However, the tip piece will still be held in the housing by the union nut so that the tip piece cannot be lost.

The union nut preferably has an inner width that expands in a conical fashion towards the tip piece so that only a small gap exists between the union nut and the tip piece to reduce the likelihood of dirt or other debris from entering into the housing. Dirt or debris could impair the mobility of the tip piece inside the housing. The conical widening of the tip piece ensures free movement of the tip piece without requiring that the union nut be placed excessively too far to the outside of the housing. The spherical disk form of the tip piece advantageously reduces the size of the housing because with the use of appropriate curves, the spherical disk can pass through the inside of the union nut relatively freely.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
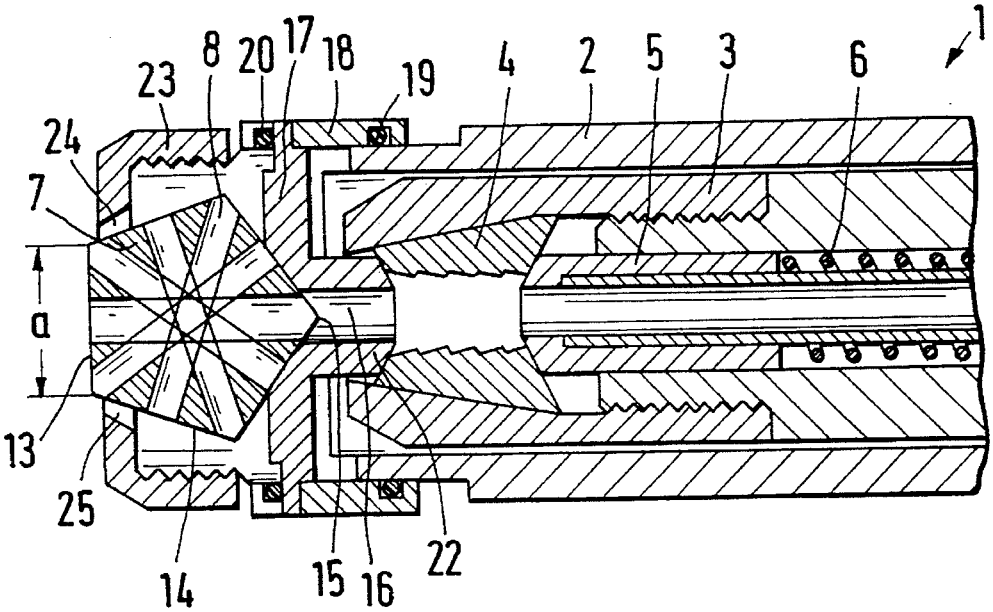
FIG. 1 is a schematic cross-sectional view through a part of a blind rivet setting device according to the present invention.

Referring now to FIG. 1, a blind rivet setting device 1 is illustrated. Device 1 includes a housing 2, a movable drawing mechanism 3 having chucking jaws 4, thrust piece 5, and a restoring spring 6. The drawing mechanism 3 can be moved to the right from the illustrated ready position by a drive (not shown), which is movable either manually or by a motor. As the drawing mechanism is moved to the right, the chucking jaws 4 move closer to each other. A rivet mandrel, which is not shown and which has been inserted into the setting device 1, is then gripped by the jaws 4 and is likewise drawn to the right. The design of a drawing mechanism of this type and the manner of working of a blind rivet are sufficiently well known to those of ordinary skill in the art and will only be described further to the degree necessary to understand how to make and use the blind rivet setting device according to the present invention.

Figure 4:
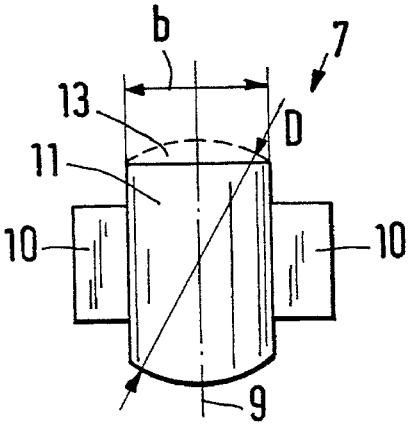
FIG. 4 is a front view of a tip piece.

A tip piece 7 is disposed at the front end of the housing 2 (to the left as illustrated in FIG. 1). Tip piece 7 has a number (five are illustrated in FIG. 1) of variable diameter mandrel guide channels 8. The tip piece is shown in front view in FIG. 4. The tip piece 7 is formed by a spherical disk 11 that has a diameter D. The spherical disk extends on both sides of a center plane 9 in an essentially symmetrical manner. The mandrel guide channels 8 are disposed in this center plane. Bearing journals 10 are placed on both sides of the tip piece 7. The tip piece 7 is supported in bearing surfaces 12 in the housing 2 by its beating journals 10. Tip piece 7 can be rotated around an axis that extends substantially perpendicularly with respect to the drawing direction of the drawing mechanism 3. The bearing surfaces 12 also support the tip piece 7 in the direction of movement of the drawing mechanism 3.

The spherical disk 11 is provided at its perimeter with a number of flattened areas 13. Since each level flattened area of a sphere forms a circular area, there exists on the perimeter of the spherical disk 11, and thus on the perimeter of the tip piece 7, a series of circular flattened areas, which have a diameter a. This diameter a essentially corresponds to the width b of the spherical disk 11. The individual adjacent circular areas that are formed by the flattened areas 13 adjoin one another in the center plane 9 of the tip piece 7. Thus, in cross-section, the tip piece 7 has the shape of a polygon in the region of its center plane 9 (see FIG. 1). This polygon has sides 14 that all have the same length a. The polygon (illustrated to be a pentagon) has an uneven number of sides 14 and corners 15 (five are illustrated). In this regard, the term corners 15 refers to the connection between two adjacent sides 14. The corners 15 can also be formed by a transition between two sides 14 which is curved or which has the form of a polygonal progression.

The mandrel guide channels 8 are illustrated as being through-channels or bores. The channels extend through the tip piece 7 from a side 14 to the oppositely disposed corner 15. Thus, there is an essentially level surface disposed around an opening of a mandrel guide channel 8, which is formed by the flattened area 13. The rivet head can lie against this level surface during the setting procedure.

Figure 3:
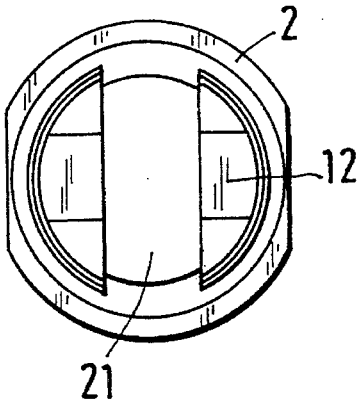
FIG. 3 is a top view of the housing, as viewed from the left from FIG. 2.

Corner 15 projects into a recess or through opening 16 in a housing part 17. Recess 16 is used to guide a rivet mandrel through to the chucking jaws 4. Recess 16 expands towards the front in an approximate V shape so that the sides 14 of the tip piece 7 lie flat against the housing part 17. The housing part 17 is fixed to a sliding part 18 that can be moved axially with respect to the housing 2, that is, from left to right and vice-versa as viewed in FIG. 1. To increase the friction between the housing 2 and the sliding part 18, a round ring 19 is provided, which can be made from robber and which provides for a frictional engagement between the sliding part 18 and the housing 2. The sliding part 18 can thus be moved with respect to the housing 2 only against a certain predetermined minimum resistance. In addition, a fastening ring 20 is provided which holds the housing part 17 to the sliding part 18. An opening 21 is disposed in the housing 2 through which the housing part 17 projects (FIG. 3).

The housing part 17 has an inwardly axially directed projection 22, which points towards the drawing mechanism 3. Projection 22 has a rear axial face 30 which is angled towards the outside, and which is used as an opening mechanism for the chucking jaws 4. The chucking jaws 4 are pressed against the rear face 30 of projection 22 by the force of the restoring spring 6. As a result, the housing part 17 is pressed against the tip piece 7 when in the ready position, which is shown in FIG. 1. The tip piece 7 is thus fixed in the set position.

A union nut 23 is provided to prevent tip piece 7 from being pressed out of the housing 2. Union nut 23 has an opening 24 through which the tip piece 7 projects. The opening 24 expands conically towards the inside. Thus, only a small gap 25 exists between the union nut 23 and the tip piece 7. The gap 25 can be kept relatively small without impairing the ability of the tip piece 7 to rotate within the housing 2 because of the shape of the tip piece 7, which originated from the spherical disk 11 and the conical expansion of the opening 24. The union nut acts upon the bearing journals 10 of the tip piece 7.

To rotate the tip piece 7, the drawing mechanism 3 is actuated so that it will move a predetermined distance towards the tight. In this regard, it is not necessary that the drawing mechanism 3 be moved all the way to its tight end position. It is sufficient for the chucking jaws 4 to release from contact with the projection 22 by such an extent that the housing part 17 can be pushed by axially moving the sliding part 18 far enough to the tight so that the tip piece 7 is free from the recess 16. In this position, tip piece 7, is no longer fixed in place, and can therefore be rotated freely within the bearing surfaces 12. As soon as the mandrel guide channel 8 with the desired diameter appears at the front, the drawing mechanism 3 can be moved back to the left so that the chucking jaws 4 will press the housing part 17 back into place against the tip piece 7. Thus, the tip piece is once again fixed in place with the desired guide channel aligned at the front. It is thus not necessary to loosen the union nut 23 to adjust the rotational position of the tip piece 7.

If a rivet is now set, the drawing mechanism 3 is moved to the right, as a result of which the pressing force against the housing part 17 decreases and is later removed. The fixing of the tip piece 7 in place is then carried out by the rivet mandrel itself which is directed through the mandrel guide channel 8 and the recess 16 into the chucking jaws 4.

The configuration of the tip piece 7 as a pentagon is sufficient for most applications because there are enough different diameters of the mandrel guide channels 8 available (i.e., five) and the tip piece is still strong enough to be able to absorb even the larger drawing forces.

Figure 2:
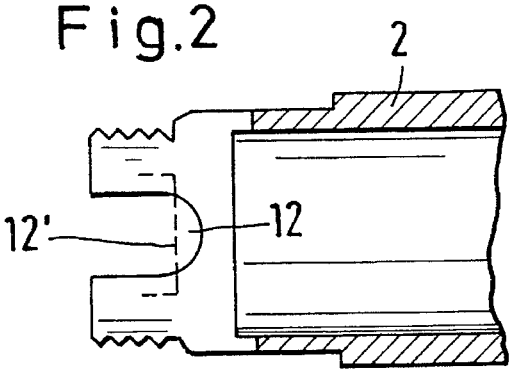
FIG. 2 is a cross-sectional view of the housing of the blind rivet setting device according to the present invention.
Figure 5:
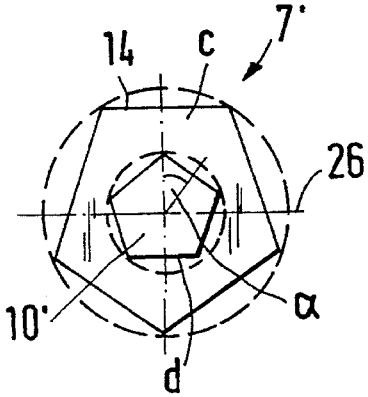
FIG. 5 is a side view of another embodiment of a tip piece.

An additional configuration of a tip piece 7' is illustrated in FIG. 5. In this embodiment, the shape of the beating journal 10' is changed from a circular cross-section to a polygonal cross-section, which in the mathematical sense is similar to the polygon of the tip piece 7'. In other words, the number of corners, the angles and the relationships of the sides are the same in the beating journal 10' as they are in the tip piece 7'. However, the polygon of the beating journal 10' is rotated by an angle $\alpha$ with respect to the polygon of the tip piece 7'. Angle $\alpha$ is equal to 180° divided by the number of sides that the polygon has (i.e., $\alpha=180°\div5=36°$ for a pentagon). Additionally, the polygon of the journal 10' is mirrored by a plane 26 that runs through the axis of rotation and parallel to a side 14. As a result, a side c of the polygon of the tip piece 7' and a side d of the polygon of the beating journal 10' are always parallel to each other. Thus, the beating journal 10' can be supported on a beating surface 12' by side d. Beating surface 12' is shown as a dashed line in FIG. 2. Thus, an additional safeguard against rotation is achieved as a result of the fact that the tip piece 7' with its bearing journal 10' must first be lifted by a certain predetermined distance from the bearing surface 12' so that it can be rotated to align a new mandrel guide channel. In this case, the loosening of the union nut 23 is required to rotate top piece 7'. Thus, housing part 17' can remain fixed to the housing, and can therefore be made as a single part along with the housing 2.

Having described the presently preferred exemplary embodiment of a new and improved blind fastener setting device, in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A blind fastener setting device comprising:

a housing;

a drawing mechanism disposed within said housing; and an adjustably supported tip piece connected to said housing, said tip piece having a plurality of mandrel guide channels, each of which can be aligned with respect to the drawing mechanism, said tip piece having a polygonal cross-sectional shape which has an uneven number of sides, each of said mandrel guide channels extending from one of said sides, said tip piece being rotatable about a substantially fixed axis, said axis being perpendicular to a drawing direction of the drawing mechanism.

2. The blind fastener setting device according to claim 1, wherein said mandrel guide channels extend from one of the sides of the polygon to an oppositely disposed corner.

3. The blind fastener setting device according to claim 1, wherein said polygon shape is a regular polygon.

4. The blind fastener setting device according to claim 1, wherein said housing has a bearing portion, the tip piece has a pair of bearing journals which project perpendicularly with respect to the mandrel guide channels in said bearing portion of the housing, said drawing mechanism being movable with respect to said bearing portion.

5. The blind fastener setting device according to claim 4, wherein said housing has a surface, at least one of the beating journals has a cross-sectional shape of a polygon with a plurality of sides that are reduced in size, in comparison with the sides of the polygon shape of the tip piece, the at least one bearing journal being rotated with respect to the polygon of the tip piece by an angle which is substantially equal to 180° divided by the number of sides that the polygon has, and the at least one of the beating journals lies against said housing surface that extends in a direction that is substantially perpendicular to the drawing direction of the drawing mechanism.

6. The blind fastener setting device according to claim 1, wherein the polygon shape includes a plurality of corners, the housing includes a housing part, the tip piece in a ready state has one of the corners of the polygon projecting into a recess in the housing part, and at least part of the sides adjacent to the projecting corner lie against the housing part.

7. The blind fastener setting device according to claim 6, wherein the housing part is movable with respect to the housing.

8. The blind fastener setting device according to claim 7, further comprising means for increasing a frictional engagement between the housing part and the housing.

9. The blind fastener setting device according to claim 7, wherein the housing has a device that applies a restoring force against the housing part, the housing part, in the ready state, is pressed against said tip piece by the restoring force.

10. The blind fastener setting device according to claim 9, wherein the restoring force acts upon the housing part via the drawing mechanism.

11. The device in accordance with claim 10, wherein the housing part is a jaw opening device for the drawing mechanism.

12. The device in accordance with claim 11, wherein each of the mandrel guide channels has a mouth opening, the tip piece is a spherical disk which is substantially symmetrical about both sides of the mandrel guide channels, and the tip piece has at least one substantially level flattened area on its perimeter in the region of the mouth opening of each of the mandrel guide channels.

13. The device in accordance with claim 12, wherein a width of the spherical disk corresponds substantially to the length of a side of the polygon.

14. The device in accordance with claim 13, further comprising a union nut connected to said housing, and said union nut holds the tip piece within the housing.

15. The device in accordance with claim 14, wherein the union nut has an inner width opening that expands in a conical fashion towards the tip piece.

16. A blind fastener setting device comprising:

a housing;

a drawing mechanism disposed within said housing; and an adjustably supported tip piece connected to said housing, said tip piece having a plurality of mandrel guide channels, each of which can be aligned with respect to the drawing mechanism, said tip piece having a polygonal cross-sectional shape which has an uneven number of sides and a plurality of corners, said mandrel guide channels extending from one of the sides of the polygon to an oppositely disposed corner.

* * * * *

UNITED STATES PATENT AND TRADEMARK OFFICE

CERTIFICATE OF CORRECTION

PATENT NO. : 5,603,151

DATED : February 18, 1997

INVENTOR(S) : Lothar WILLE

It is certified that error appears in the above-indentified patent and that said Letters Patent is hereby corrected as shown below:

On Title page, item [30], Foreign Application Priority Data, change "44 22 877.5" to --44 22 877--.

Signed and Sealed this

Fifth Day of August, 1997

Bruce Lehman

*Attest:*

BRUCE LEHMAN

*Attesting Officer*

*Commissioner of Patents and Trademarks*